United States Patent [19]

Kameyama et al.

[11] Patent Number: 4,978,313

[45] Date of Patent: Dec. 18, 1990

[54] MOVABLE CONNECTOR

[75] Inventors: Isao Kameyama, Shizuoka, Japan; Masaaki Yoshizawa, Cologne, Fed. Rep. of Germany

[73] Assignee: Yazaki Corporation, Japan

[21] Appl. No.: 379,882

[22] Filed: Jul. 14, 1989

[30] Foreign Application Priority Data

Jul. 15, 1988 [JP] Japan ..... 63-93067[U]

[51] Int. Cl.[5] ..... H01R 13/631

[52] U.S. Cl. ..... 439/248; 439/552

[58] Field of Search ..... 248/27.1, 56; 439/248, 439/553, 556, 559, 567, 549, 557, 552

[56] References Cited

U.S. PATENT DOCUMENTS

| | | | |
|---|---|---|---|
| 3,573,716 | 4/1971 | Garver | 339/128 |
| 4,405,196 | 9/1983 | Fulton | 439/551 |

FOREIGN PATENT DOCUMENTS

| | | | |
|---|---|---|---|
| 1590585 | 5/1970 | Fed. Rep. of Germany . | |
| 59-20578 | 2/1984 | Japan . | |
| 712880 | 1/1980 | U.S.S.R. | 439/248 |
| 1072159 | 2/1984 | U.S.S.R. . | |
| 508349 | 6/1939 | United Kingdom | 439/552 |

*Primary Examiner*—Eugene F. Desmond

*Attorney, Agent, or Firm*—Wigman & Cohen

[57] ABSTRACT

A movable connector having a movable housing which is to be secured to a panel is provided with a rubber member for insertion into a fitting groove formed in the panel. The rubber member serves to flexibly absorb displacements caused when a partner housing from a partner connector is fitted to the movable housing and also acts as a protective cushioning to prevent damage from occuring to the movable connector. In addition, by choosing a heat-resistant material for the rubber member, the movable connector can be effectively utilized in high-temperature environments.

12 Claims, 3 Drawing Sheets

MOVABLE CONNECTOR

BACKGROUND OF THE INVENTION

1. Field of the Invention

The present invention relates to a movable connector, and more particularly to a movable connector operable in high-temperature environments and capable of flexibly absorbing displacements caused when a partner connector is fitted to the movable connector.

2. Description of the Prior Art

In the prior art of connectors having male and female housings which are automatically connected to each other by machinery, such as when wire harnesses are connected to instrumentation during the assembly of automobiles, it has been suggested in Japanese Laid-Open Utility Model Publication No. 59-20578 that one of the housings be made flexibly movable in a panel to absorb any displacements caused when the two housings are fitted together.

As shown in FIG. 5 of Japanese Laid-Open Utility Model Publication No. 59-20578, a connector proposed for the above-mentioned purpose comprises a male housing and a bracket which is formed separately from the male housing. The bracket has fitting portions, which include flexible engagement arms for flexibly supporting the male housing, and mounting members for securing the male connector to a panel.

In the structure described above, the fitting portions and the mounting members enable the male housing to absorb small positional changes when a female housing is joined thereto. However, since the male housing and the bracket are separately formed and assembled together when they are mounted to the panel, the number of parts that need to be manufactured and assembled is unavoidably increased, which results in increased manufacturing costs and assembly time.

Furthermore, according to the structure above, the overall size of the connector has to be made relatively large, and this results in a more complicated manufacturing process.

In response to these problems, an invention was recently disclosed in U.S. Pat. application Ser. No. 07/307,482 for overcoming the disadvantages of the prior art connectors.

As shown in FIG. 1, one embodiment of that invention comprises a movable connector C having a male connector housing 20 to which is fitted a partner female connector housing (not shown). Near the rear portion of the male housing 20 there is formed an annular spring member 14 on each side surface thereof, and between any two spring members 14 there is formed a guide flange 15. The movable connector is constructed such that the annular springs 14 will press against the bottom 8 of a groove 7 formed in an inner edge defining an opening 6 of a panel P for supporting the movable connector A.

In the above structure, the male housing 20 and the annular spring members 14 are formed together as a single unit from a synthetic resin such as a polyamide resin, a polypropylene resin or the like.

The panel P which supports the male housing 20 is comprised of two panels P1 and P2 which are joined together by screws or the like. For accommodating the male housing 20, notches *6a* and *6b* are formed in the panels P1 and P2, respectively, which fit around the outer periphery of the connecter when the connecter is mounted in the panel P. The notches *6a* and *6b* comprise the opening 6, with the groove 7 being formed in the inner edges of the panels P1 and P2 that define the notches *6a* and *6b*.

Thus, when the male housing 20 is mounted in the panel P, the spring members 14 are in flexible abutment with respective surfaces that define the groove bottom 8 of the groove 7. This results in an elastic support for the connector C and permits flexible movement therefor.

Moreover, with the above structure the connector C will be able to flexibly absorb any displacements caused during the fitting of the female housing to the male housing 20 even when the fitting is carried out with minor misalignment of the two housings.

Unfortunately, however, even though the invention described above provides many advantages over the prior art, it has limitations and cannot be used to solve other disadvantages of the prior art connectors.

Namely, due to the structure, and in particular to the resins employed, in high temperature environments, such as engine compartments and the like the spring members 14 will lose some of their springiness and even undergo plastic deformations. This can adversely affect maintenance and refitting of the housings.

Furthermore, in the inadvertent event that the connector is dropped or hit against something, damage will quite likely be inflicted upon the spring members 14.

SUMMARY OF THE INVENTION

In view of disadvantages of the prior art movable connectors and the invention described above, it is an object of the present invention to provide a movable connector having a simple structure which is capable of flexibly absorbing displacements caused when a partner connector is fitted to the movable connector.

It is another object of the present invention to provide a movable connector having a compact and inexpensively producible means for absorbing displacements caused when a partner connector is fitted to the movable connector.

It is a further object of the present invention to provide a movable connector having a displacement absorbing means that can function effectively in high-temperature environments.

It is still another object of the present invention to provide a durable movable connector which is resistent to damage from shocks or forces.

It is still a further object of the present invention to provide a connector which can easily be mounted in a panel.

In order to achieve the above-mentioned objects, the movable connector of the present invention comprises a housing which is flexibly mountable to a panel having an opening formed at a mounting portion thereof. For the purpose of forming a flexible fit with the panel, the connector has a rubber member provided around the connector housing for insertion into a fitting groove formed in an inner edge of the panel defining the opening of the mounting portion. When mounted, the rubber member flexibly abuts the bottom of the fitting groove to enable flexible movement of the connector.

In the present invention, the rubber member is formed as a separate ring-like element that is then stretched over the housing and attached thereto. For supporting the rubber member, guide portions are provided around the side surfaces of the connector housing to form a concave-like passage in which the rubber member resides. In addition, these guide portions serve to abut the side walls of the fitting groove when the connector is mounted to the panel.

For standard type, movable connectors having male and female partner housings, the structure of the connector housing according the present invention can be applied to either housing, but the preferred practice would be to apply this structure to the male housing because the male housing is typically the one that is mounted in a panel.

The foregoing, and other objects, features, and advantages of the present invention will become more apparent from the detailed description of the preferred embodiment taken in conjunction with the accompanying drawings.

DETAILED DESCRIPTION OF THE PREFERRED EMBODIMENT

Figure 1:
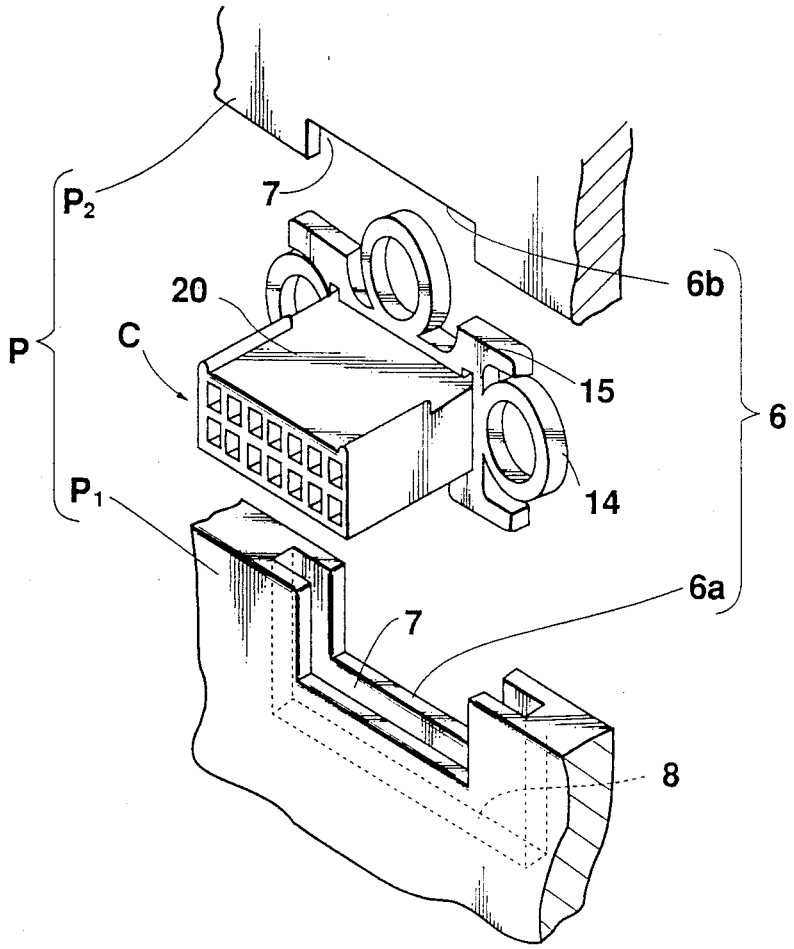
FIG. 1 is a perspective view of a movable connector shown in the prior application mentioned above.
Figure 2:
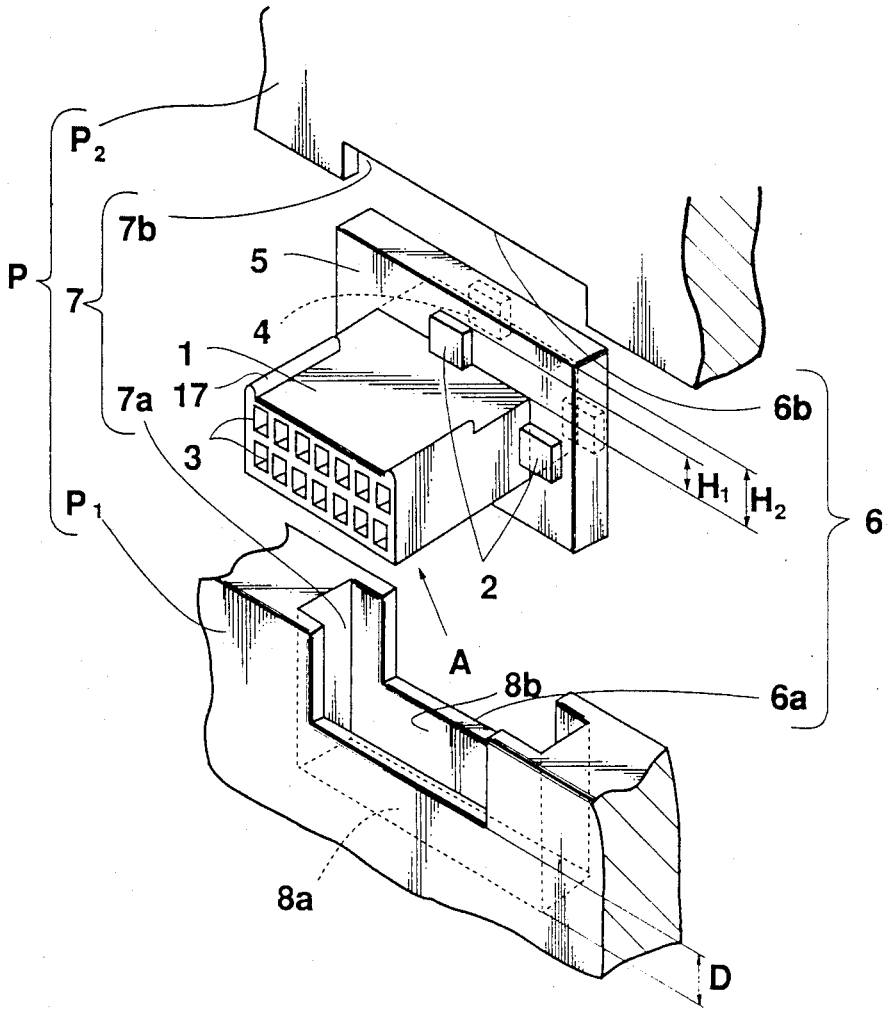
FIG. 2 is a perspective view showing a movable connector according to the present invention and a panel to which the movable connector is to be mounted.

With reference to FIG. 2, a movable connector A is shown to comprise a male connector housing 1 which is engagable with a female partner housing (not shown). The male housing 1 has a basic rectanguloid shape with front and rear ends and four side surfaces. Near the rear end of the housing 1 on each side surface thereof a pair of thin plate-like guide members 2 is provided so as to be parallel to each other. The guide members 2 are set to have a height $H_1$, and taken together the guide members 2 form a concave-like passage 4 over the side surfaces of the male housing 1.

Provided within the passage 4 and supported by the guide members 2 is a ring-like rubber member 5 having a height $H_2$ greater than the height $H_1$ of the guide members 2. The rubber member 5 is made as a separate element, which in a non-attached state has a rectangular ring-like shape with four rounded corners. When the rubber member 5 is to be attached to the male housing 1, it is first stretched over the male housing 1 and then mounted within the passage 4. For allowing the movable connector A to be useful in high-temperature environments, the rubber member 5 is made from a rubber material chosen from heat-resistant rubbers such as nitryl-based or fluoro-based rubbers.

At the front end of the male housing 1 there are a plurality of terminal receiving chambers 3, each of which houses a female terminal (not shown) engagable with a corresponding male terminal (not shown) of the female housing of the partner connector. In addition, on one of the side surfaces of the male housing 1 (the top surface as viewed in FIG. 2), a guide ridge 17 is provided for guiding a guide groove (not shown) formed in an inside surface of the female housing, by which it is possible to confirm a proper orientation of the female housing with respect to the male housing 1 when engagement takes place.

Now, with further reference to FIG. 2, a panel P for holding the male housing 1 comprises a fixed panel $P_1$ and a fitting panel $P_2$ which is fastenable to the fixed panel $P_1$ by screws or the like. The panels $P_1$ and $P_2$ are provided, respectively, with opposing c-shaped notch portions **6*a* and 6*b* which, upon the fastening of the fitting panel $P_2$ to the fixed panel $P_1$, form a closed rectangular space defining the opening portion 6. For allowing displacement of the male housing 1 with respect to the panel P, the opening portion 6 is preferably made to have dimensions slightly larger than those of a cross section of the male housing 1** taken along a plane perpendicular to the side faces thereof.

In the inside edges of the panels $P_1$ and $P_2$ that define the notch portions **6*a* and 6*b* are formed fitting grooves 7*a* and 7*b*, respectively. The fitting grooves 7*a* and 7*b* are formed so as to be in alignment with each other in order to define a single rectangular fitting groove 7 when the panels $P_1$ and $P_2$ are fastened together. The depth D of the fitting groove 7 is set to lie roughly between the the height $H_1$ of the guide members 2 and the height $H_2$ of the rubber member 5. The width of the fitting groove 7 is set such that the outer periphery of the rubber member 5 will abut a groove bottom 8*a* when the rubber member 5 is inserted into the fitting groove 7**.

In fitting the male housing 1 to the panel P, a half portion of the rubber member 5 and guide portions 2 is inserted into the fitting groove **7*a* of the fixed panel $P_1$. Next, the fitting panel $P_2$ is fitted over the male housing 1 in such a manner that the remaining half portion of the rubber member 5 and guide members 2 becomes inserted into the fitting groove 7*b* of the fitting panel $P_2$. Then, after the panels $P_1$ and $P_2$ have been fastened together by the previously mentioned fastening means, the rubber member 5 and the guide members 2 will reside within the fitting groove 7, with the rubber member 5 flexibly abutting the groove bottom 8*a* of the fitting groove 7**.

Figure 3:
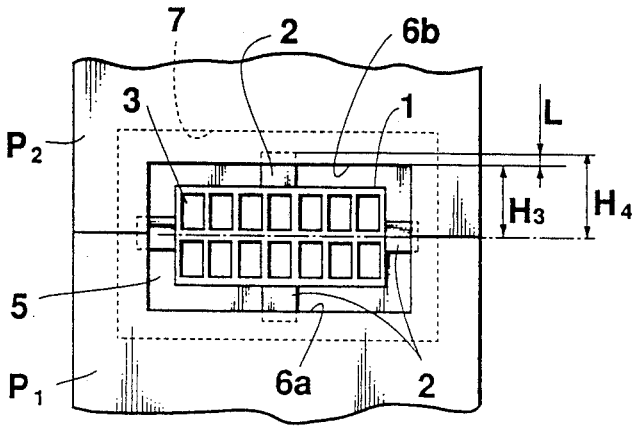
FIG. 3 is a front view of a movable connector according to the present invention.

An example of a mounted state of the male housing 1 within the panel P is illustrated in FIG. 3. As shown in this figure, when the male housing 1 is mounted within the panel P, portions of both the rubber member 5 and the guide members 2 reside within the fitting groove 7. In this example, the portion of each guide member 2 that lies within the fitting groove 7 has length $L=H_4-H_3$, where $H_3$ and $H_4$ are the distances measured from the center of the housing 1 to the inner edge of the opening 6 and the ends of the guide members 2, respectively. These portions of the guide members 2 that reside within the fitting groove 7 act as stoppers against the side walls **8*b* of the fitting groove 7 when the male housing 1 is experiencing any movement in the axial direction, and they are in sliding abutment with the side walls 8*b* when the male housing 1** is moving within the plane of the panel P.

In the structure described above, the male housing 1 is able to move flexibly by slight amounts so as to absorb any minor forces or shocks imparted thereto. This is a direct result of the compressibility and elasticity of the rubber member 5. In order to better understand how this is done, a specific example explaining the function of the rubber member 5 will be given with reference to FIG. 4.

Figure 4:
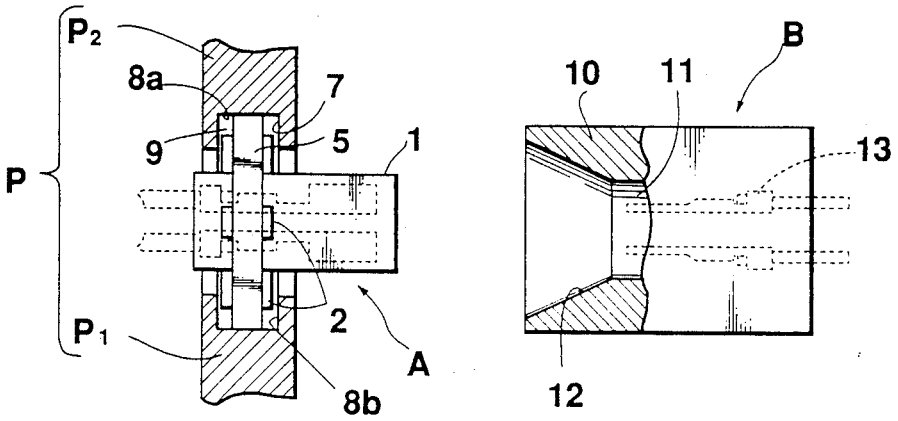
FIG. 4 is a side cross-sectional view showing a female housing in a state of being brought toward engagement with the male housing shown in FIG. 2.

Namely, in FIG. 4 the movable connector A is shown in a mounted state within the panel P. Also shown is a partner connector B just prior to being fitted to the connector A. The connector B comprises a female housing 10 having a tapered guide 12 forming an opening that leads to a terminal holding chamber 11 in which is provided a plurality of male terminals 13.

Now, in the event that there is any misalignment between the male and female housings 1 and 10 when the female housing 10 is being fitted to the male housing 1, the front end of the male housing 1 will abut the tapered guide 12 of the female housing 10. As a result, the misalignment will give rise to an external force that will try to move the male housing 1 from its normal position within the panel P.

However, in response to this external force, the rubber member 5 will compress against the groove bottom 8*a* of the fitting groove 7, which will allow the male housing 1 to flexibly move in the direction of the external force and thereby absorb such force. As this happens, the portions of the rubber member being compressed against the groove bottom 8*a* will undergo elastic deformation, with any excess thickness resulting from such deformation being accommodated by spaces 9 formed between the fitting groove 7 and the guide members 2. Then when the external force has subsided, the rubber member 5 will regain its normal shape and thereby return the male housing 1, together with the fitted female housing 10, to its normal position.

Thus, in concert with the objectives stated above, it is possible to provide a movable connector which is capable of flexibly absorbing displacements caused when a partner connector is fitted to the movable connector. Moreover, as the function of the rubber member remains unchanged even after the two housings are fitted together, the joined connectors can flexibly move to absorb any forces or shocks caused by such things as the connectors being struck or the connector wires being pulled.

In addition, since the rubber member is made from a heat-resistant rubber, the connector can be employeed in high-temperature environments, such as the engine compartment of an automobile, without losing its effectiveness and with no worry of heat-induced deformations. As a result, maintenance and replacement are very easy to perform.

Furthermore, the present invention includes the function of protecting the connector against inadvertent damage that might occur even before the connector is mounted within the panel. This is because the rubber member acts, as an elastic padding that surrounds and cushions the connector against accidental drops or other such physical shocks.

Lastly, it is to be understood that even though the present invention has been described according to its preferred embodiment, many modifications and improvements may be made without departing from the scope of the invention as defined in the appended claims.

What is claimed is:

1. A movable connector, comprising:

a first housing adapted to be mounted to an opening of a panel, the panel having a mounting groove formed in an inner edge surface defining the opening;

a second housing engagable with the first housing; and an elastic rubber member for flexibly supporting the first housing with respect to a panel, the elastic rubber member being provided around the first housing so as to be fitted to the mounting groove of the opening of the panel when the first housing has been mounted to the opening of the panel through the elastic member.

2. The movable connector of claim 1, wherein the rubber member is made from a heat-resistant rubber.

3. The movable connector of claim 1, wherein the first housing is a male housing and the second housing is a female housing.

4. The movable connector of claim 1, wherein the first housing is a female housing and the second housing is a male housing.

5. The movable connector of claim 1, wherein the mounting groove of the panel has a groove bottom, and a portion of the rubber member is adapted to abut the groove bottom when the first housing is mounted to the opening of the panel.

6. The movable connector of claim 5, further comprising means for supporting the rubber member.

7. The movable connector of claim 6, wherein the first housing has four side surfaces and the rubber member has a rectangular ring-like shape which surrounds all four side surfaces of the first housing.

8. The movable connector of claim 7, wherein the supporting means comprises a plurality of guide members formed on the first housing.

9. The movable connector of claim 8, wherein the rubber member is made to have a uniform height measured with respect to each side surface of the first housing, and the guide members are made to have heights that are less than the height of the rubber member.

10. The movable connector of claim 9, wherein each guide member comprises a pair of parallel plate-like portions formed on the first housing, the plate-like portions having a space provided therebetween for accommodating the rubber member.

11. The movable connector of claim 10, wherein a portion of each guide member resides within the mounting groove when the first housing is mounted within the opening of the panel.

12. A movable connecting device adapted to be mounted within an opening of a panel, the panel having a mounting groove formed in an inner edge surface defining the opening, comprising:

a connector housing engageable with a partner housing; and an elastic rubber member for flexibility supporting the connector housing with respect to the panel, the elastic rubber member being provided around the first housing so as to be fitted to the mounting groove of the opening of the panel when the connector housing has been mounted to the opening of the panel through the elastic member.

* * * * *